United States Patent [19]

Rando

[11] Patent Number: 4,930,263

[45] Date of Patent: Jun. 5, 1990

[54] FORMING MARKINGS ON A VIAL SURFACE

[75] Inventor: Joseph F. Rando, Los Altos Hills, Calif.

[73] Assignee: Spectra-Physics, Inc., San Jose, Calif.

[21] Appl. No.: 353,718

[22] Filed: May 18, 1989

[51] Int. Cl.[5] ..... B24B 49/00

[52] U.S. Cl. ..... 51/165.71; 51/165.77; 235/487

[58] Field of Search ..... 235/487; 51/165.71, 51/165.77, 48 R, 95 R, 374, 283 R, 283 E

[56] References Cited

U.S. PATENT DOCUMENTS

| | | | |
|---|---|---|---|
| 3,229,126 | 10/1966 | Barron | 51/95 R |
| 4,291,507 | 9/1981 | Littlehorn, Jr. | 51/374 |
| 4,327,283 | 4/1982 | Heyman et al. | 235/487 |
| 4,810,867 | 3/1989 | Speicher . | |

*Primary Examiner*—Frederick R. Schmidt
*Assistant Examiner*—M. Rachuba
*Attorney, Agent, or Firm*—Skjerven, Morrill, MacPherson, Franklin & Friel

[57] ABSTRACT

Glass laboratory vials are marked by grinding the surface of the vial with an abrasive wheel. The vial is moved relative to the wheel under control of a computer so as to automatically grind a desired bar code or alpha-numeric symbols into the surface. The ground portion of the surface of the vial scatters light while the unground portion of the surface transmits light.

The process is automated and can be performed by a robot as part of an analyzing or processing system. The ground-in markings are more enduring than the prior art paper labels.

28 Claims, 2 Drawing Sheets

FORMING MARKINGS ON A VIAL SURFACE

BACKGROUND OF THE INVENTION

1. Field of the Invention

This invention relates to a method and device for marking an object, and more specifically to a method and device for forming bar code markings on the surface of a transparent container as part of an integrated handling system.

2. Description of the Prior Art

It is well known in the art to mark objects such as glass containers by molding, inscribing, etching or otherwise altering the surface of the object.

It is also known in the art to imprint marks on the surface of an object, for instance as described in U.S. Pat. No. 4,810,867, issued to Speicher on Mar. 7, 1989. Speicher discloses a method for imprinting bar codes on an object using an imprinting device which imprints a matrix of dots on an object which is fixed to a table assembly.

Speicher's method, as is typical of dot matrix imprinting methods, is not suitable for marking brittle materials such as glass. Also, prior art methods such as those of Speicher are typically most useful for flat items which can be readily attached to a table.

In many laboratory applications, glass or plastic vials or test tubes are marked either with a conventional bar code (to allow automated reading) or with alphanumeric markings to identify the contents. Typically paper labels having printed markings are glued on to vials. This method is deficient because the labels tend to come off when exposed to liquids or chemicals so that the information on the label is lost. Also, any surplus adhesive on the label can gum-up mechanisms in automatic handling deices (i.e., robots) often used in automated laboratory machinery. When the vials are heated, the heat can destroy the glue holding the labels on, causing the labels to fall off.

In addition, the paper labels must be glued on manually, which prevents full automation of the process of handling the vial. The paper labels also undesirably prevent viewing the contents of the vial.

SUMMARY OF THE INVENTION

In accordance with the invention, a device is provided to form grooves in the surface of a glass vial or other object. The grooves make up a bar code or any other kind of marking. In the preferred embodiment of the invention, the grooves are ground by an abrasive wheel; the object is moved relative to the wheel so as to grind in the desired markings. The ground portion of the surface of the object scatters light while the unground portion of the surface transmits light. Thus when the ground markings are a bar code, the ground areas are the conventionally "white" (i.e., reflective) background areas of the bar code, and the unground areas, which do not reflect light, are the conventionally "black" (nonreflective) bars of the bar code.

This process may be automated. This process has the advantages over the prior art of working well with the rather brittle and fragile glass typically used for laboratory containers. The process allows easy viewing of the vial contents. The markings are very durable in the face of heat, chemicals, water, etc., and eliminate the presence of adhesives or paper labels.

An object of the invention is to provide a method for marking an object with a durable mark.

Another object of the invention is to provide a device for marking objects as part of an overall analyzing and chemical processing system.

A further object of the invention is to provide a bar code marking for a transparent object where the marked areas are the white areas of the bar code, and the unmarked areas are the dark bars of the bar code.

BRIEF DESCRIPTION OF THE DRAWINGS

Similar reference numbers in various figures denote similar or identical structures.

DETAILED DESCRIPTION OF THE INVENTION

Figure 1:
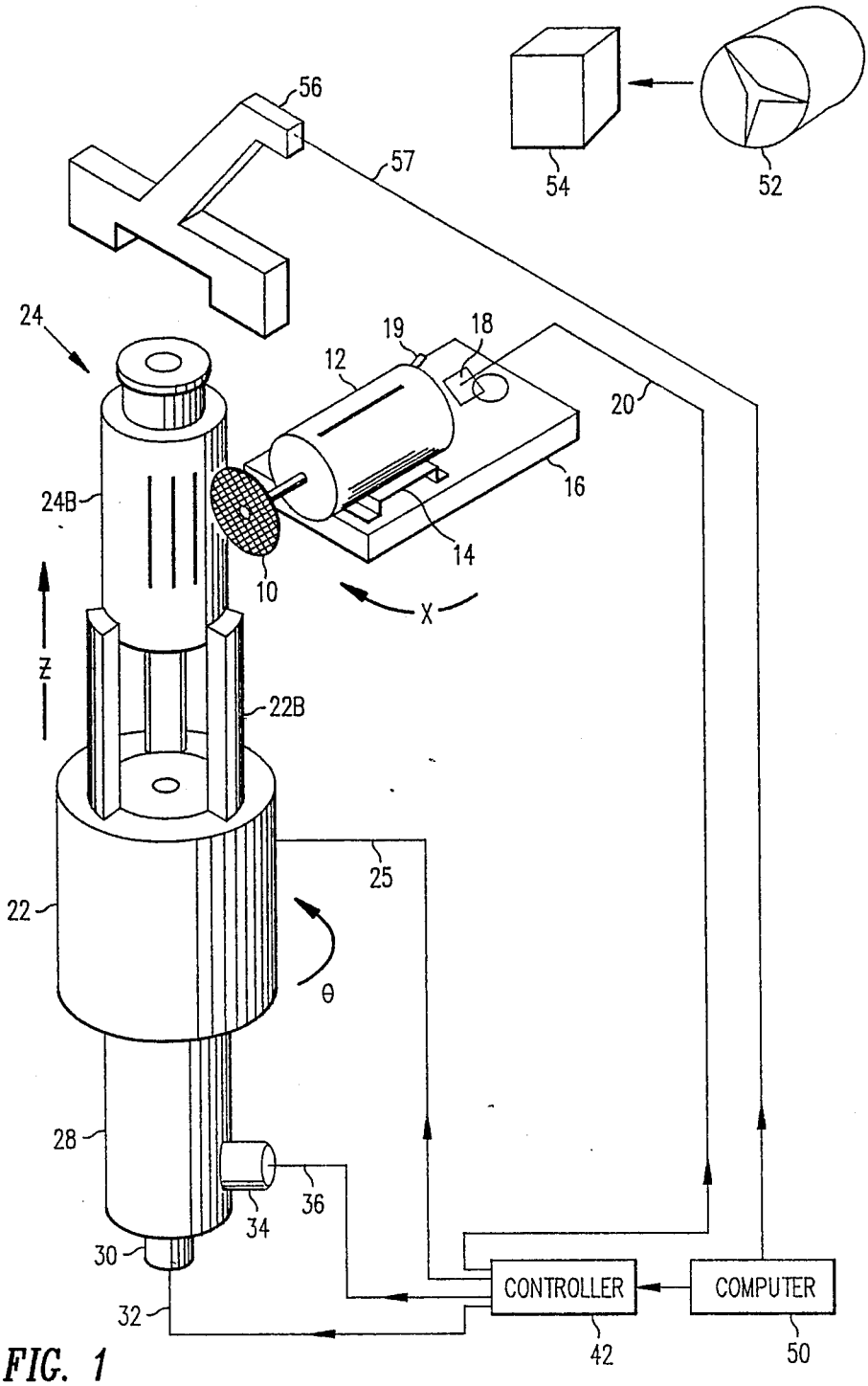
FIG. 1 shows a device in accordance with the invention.

In accordance with the invention, an apparatus as shown in FIG. 1 is provided to grind markings into glass (or plastic or similar material) laboratory vials or test tubes or other objects. Grinding wheel 10 is preferably a diamond grinding wheel of the type commercially available from Marshall Laboratories. Grinding wheel 10 is preferably one inch (2.54 cm) in diameter and 0.006 inch (0.15 mm) thick. The typical minimum width of a bar code line is 0.008 inch (0.2 mm) so this thickness of grinding wheel is suitable for grinding bar codes. A thicker wheel (0.008 inch) may also be used conveniently to grind in thicker lines. The dimensions of the grinding wheel are not critical to the invention. Other grinding wheels (such as carborundum or silicon carbide) may be used also. Grinding wheel 10 is mounted on the shaft of a conventional small high speed electric motor 12, preferably capable of 3,000 R.P.M. or better.

Motor 12 is conventionally provided with electrical current (not shown). Electric motor 12 is mounted on a flexible rectangular mount 14 (i.e., a "flexure") which is made of brass about 0.008 inch (0.2 mm) thick and is about one inch high (2.54 cm) and about one inch wide. Flexure 14 is U-shaped as shown, with the leg portions fixed to the base and the connecting portion fixed to motor 12.

Flexure 14 is fixed to a base 16. Also fixed to base 16 is a conventional solenoid 18, such as is commercially available from Ledex, which is mounted so that when solenoid 18 is activated by provision of a control signal on line 20, the electromagnet (not shown) in solenoid 18 attracts a steel or iron plunger 19 fastened to the motor 12. Since motor 12 is mounted on flexure 14, activation of solenoid 18 pulls motor 12 a small distance of about 0.03 inch (0.75 mm) in direction "X" as shown. Thus motor 12 translates a small distance in direction X under control of solenoid 18, providing one degree of freedom.

Provided in close proximity to grinding wheel 10 is a chuck 22. Chuck 22 is a conventional three-jawed chuck similar in configuration to what is used in machine tools. Chuck 22 is of a size and strength to conveniently grip a glass laboratory vial 24 (or a test tube). (The typical vial 24 is 1 cm to 3 cm in diameter.) Chuck 22 is a conventional electrically operated chuck that has at least two positions: open, when its jaws 22B are open, and closed, when its jaws 22B grip a vial such as vial 24. Preferably chuck 22 has several closed positions, so as to be able to grip vials of varying sizes. The position of the jaws is conventionally determined by electrical control signals provided to chuck 22 over control line 25.

Chuck 22 is mounted on one end of a conventional translation/rotation mechanical stage (i.e. a holder) 28. Mechanical stage 28 has two degrees of freedom: first, it can move up or down in direction Z as shown relative to grinding wheel 10; second, robot arm 28 can rotate angularly in direction $\theta$ as shown. Conventional stepper motor 30 controls movement in direction Z under the direction of signals provided on control line 32 and conventional stepper motor 34 controls the movement of robot arm 28 in direction $\theta$ under the direction of control signals provided on control line 36.

Control lines 20, 25, 32, and 36 are all connected to controller 42. Controller 42 is connected to host computer or automated laboratory instrument 50. Controller 42 is a conventional commercially available microprocessor or a computer.

Also, provided in close proximity to grinding wheel 10 is an exhaust fan 52 which sucks air away from grinding wheel 10 into container 54 to remove debris generated by grinding. Alternatively, a weak vacuum system (not shown) sucks away the air. A conventional robot arm 56 is preferably provided to place and remove vial 24 in chuck 22. Robot arm 56 is controlled by computer 50 via control line 57.

Figure 2:
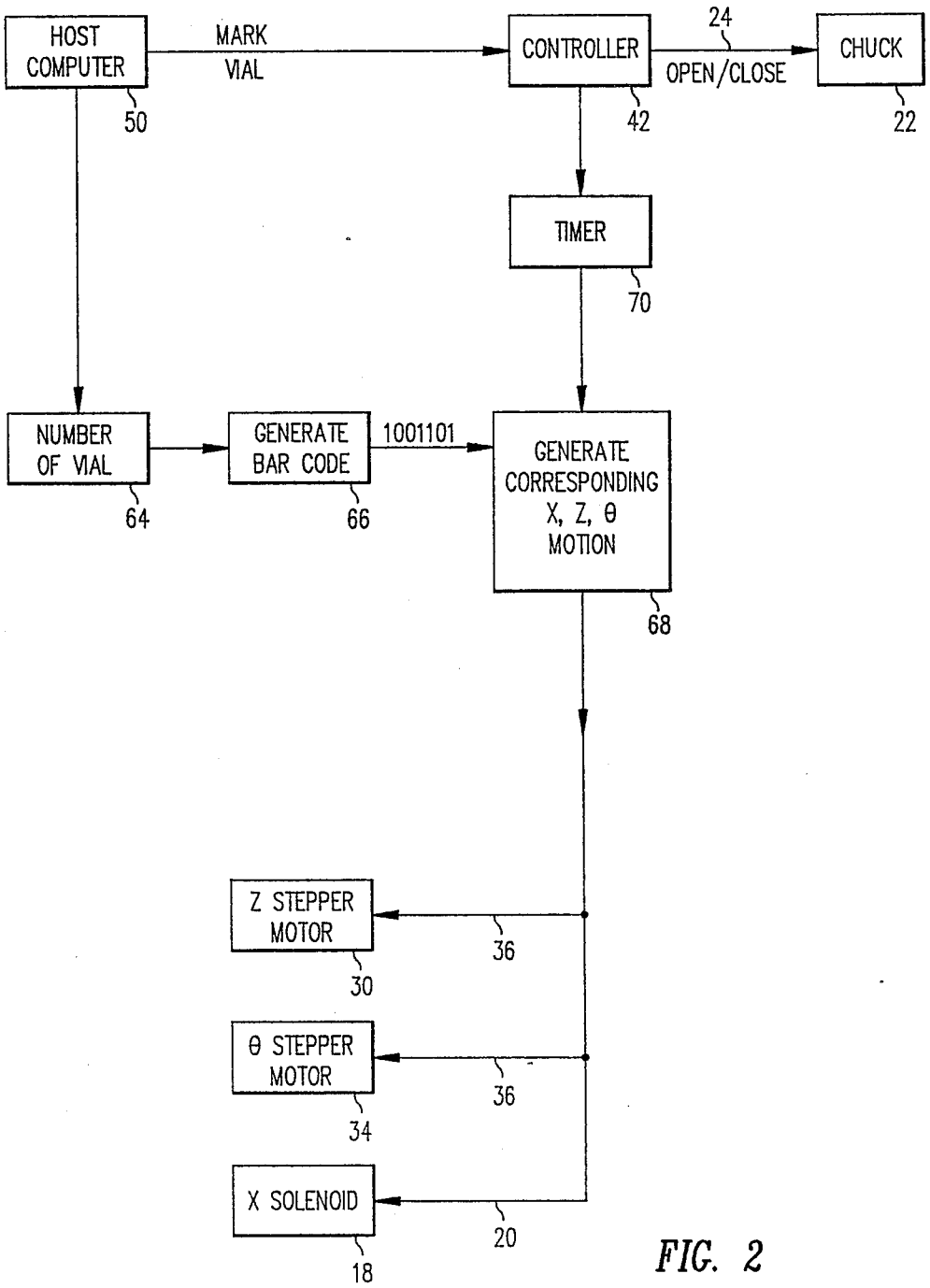
FIG. 2 shows a block diagram of a process in accordance with the invention.

The operation of the above-described apparatus is explained with reference to the block diagram shown in FIG. 2.

Host computer 50 provides to controller 42 a "mark vial" command 50, and also provides the unique number of vial 64 which is the information to be marked on the vial. Controller 42 then generates a bar code at step bar code 66 by conventional computer software. A set of corresponding bar code numbers such as the binary string 1001101 is created at step 66. The controller then conventionally by means of computer software translates this binary string into corresponding X, Z, and $\theta$ control signals at generate motion step 68 for respectively solenoid 18, stepper motor 30, and stepper motor 34.

Upon receiving the mark vial command, controller 42 issues a command on line 24 to chuck 22 to open its jaws. At this time, the robot arm 56 places a vial 24 (taken for instance from a box of vials, not shown) into the jaws of chuck 22. After a brief time interval determined by timer software 70 which is part of the software of controller 42, the jaws of chuck 22 close upon receiving a "chuck close" command on line 24.

The actual process of grinding the bar code markings includes the steps of mechanical stage 28 being moved up in direction Z by stepper motor 30 until a portion of the surface of vial 24 is in contact with the edge of grinding wheel 10, which is rotating at about 3,000 R.P.M.

Controller 42 sends a control signal to solenoid 18 on line 20; this signal energizes solenoid 18 and pulls motor 12 in direction X about 0.75 mm into the grinding position. The edge of grinding wheel 10 thereby grinds a line in the surface **24*b* of vial 24. Stepper motor 30 then moves robot arm 28 up slightly further (i.e., one step) in direction Z, to extend the line ground in the surface 24B of vial 24. Stepper motor 30 keeps moving the mechanical stage 28 and hence vial 24 upwards in direction Z, until one line of a bar code has been ground. Preferably the depth of cut of the line ground in surface 24B is about 0.002 inches (0.051 mm). The relative speed of translation of vial 24 relative to grinding wheel 10** is preferably about two to ten inches (5 to 25 cm) per second.

If the marking being ground into surface 24B is a narrow line, then only one pass of grinding wheel 10 is sufficient to make a line of sufficient width. If a wider line is desired, as is typically used in certain bar code symbols, then stepper motor 34 rotates the mechanical stage 28 slightly in direction $\theta$ and then stepper motor 30 moves chuck downward (in direction Z) as grinding wheel 10 grinds a second line along surface 24B parallel to and slightly spaced apart from the first line. If necessary, a third or fourth line can be ground in surface 24B to provide a line of any desired width. A bar code is shown on surface 24B.

When one bar code line has been completed, the control signal provided by controller 42 to solenoid 20 is terminated, which causes motor 12 and grinding wheel 10 to move in direction X, away from surface 24B. Then by providing a control signal to stepper motor 34, controller 42 can rotate mechanical stage 28 to another position so that the next bar code line can be ground.

This process as described above is repeated until a complete bar code symbol is ground into surface 24B. As is evident, any sort of symbol or pattern such as letters or numbers or other markings such as pictures can be ground into surface 24B by suitable control of solenoid X and stepper motors 30 and 34 by controller 42. The bar code or other markings can be any desired size, and the width of the ground line and its depth are a function of the material and width of grinding wheel 10.

During the grinding process, the exhaust fan 52 is operating to pull the dust resulting from the grinding into container 54, for disposal.

After the markings are ground into surface 24B, the mechanical stage 28 moves in direction Z (downwards) to withdraw the vial from the vicinity of grinding wheel 10. Then the jaws of chuck 22 are opened by a control signal on line 24. Then the robot arm 56 grasps the top of vial 24 and removes vial 24 from chuck 22 and places vial 24 in its box (not shown) or in some other location as desired.

As can be appreciated, the above described marking process can be performed on an empty vial or on a vial already containing a sample. The process can be used to inscribe the results of a test on the contents of the vial on the vial, or merely to number or otherwise mark a vial so as to identify it.

The time to form markings on a vial is typically relatively brief; a typical bar code 0.6 inches high by 1.2 inches long (1.5 cm by 3 cm) would typically take less than ten seconds of actual grinding time on a glass vial.

In another embodiment, the invention is applicable to forming markings on objects other than vials, such as flat objects.

In yet another embodiment, a method other than an abrasive wheel, such as sand blasting, is used to grind the object to be marked. Also, larger or smaller abrasive wheels than that described above may be used.

In yet another embodiment, the vial is held stationary and the grinding wheel is moved around the vial.

In yet another embodiment, the robot arm and/or mechanical stage are dispensed with, and the operation is performed partially or wholly manually.

In yet another embodiment, after the markings are made, they are verified as being accurate, for instance by a conventional bar code reader that automatically reads the markings and verifies that they agree with the information supplied by computer 50 as the information to be marked on the vial.

The above description of the invention is illustrative and not limiting. Within the scope of the following claims, the invention may be practiced otherwise than as specifically described above.

I claim:

1. A method for forming markings in a cylindrical surface of an object, comprising the steps of:

providing the object;

providing instructions as to the markings to be formed;

rotating the object around an axis of the cylindrical surface in accordance with the instructions; and grinding the cylindrical surface of the object by a grinding wheel in accordance with the instructions so as to form the markings in the surface;

wherein the axis of the cylindrical surface is parallel to a tangent of the grinding wheel at a point at which the grinding wheel contacts the surface.

2. The method of claim 1, wherein the step of providing the object comprises the step of holding the object in a holder.

3. The method of claim 2, further comprising the step of moving the object relative to the grinding wheel in accordance with the provided instructions.

4. The method of claim 2 wherein the holder and the grinding wheel have at least three degrees of freedom relative to each other.

5. The method of claim 4, further comprising the step of mounting the grinding wheel on a flexure movable relative to the object so as to provide one of the degrees of freedom.

6. The method of claim 2, wherein the grinding wheel has a thickness of less than about 0.008 inch.

7. The method of claim 1, wherein the step of removing material further comprises the step of forming a plurality of parallel lines in the surface of the object.

8. The method of claim 7, wherein the plurality of parallel lines comprise a bar code.

9. The method of claim 8, wherein portions of the surface of the object from which material has been removed comprise light reflecting areas of the bar code.

10. The method of claim 1, wherein the instructions are provided by a computer.

11. The method of claim 1, wherein all the steps are under control of a computer.

12. The method of claim 1, wherein the symbols comprise a bar code.

13. The method of claim 1 further comprising the step, after the step of removing material, of verifying that the markings are in accordance with the provided instructions.

14. The method of claim 1, wherein the object comprises a transparent material.

15. A method of forming a bar code having a plurality of non- reflecting lines in a cylindrical surface of a transparent object comprising the steps of:

providing the object;

rotating the object around an axis of the cylindrical surface; and grinding a plurality of spaced apart lines in the cylindrical surface of the object by a grinding wheel;

wherein the axis of the cylindrical surface is parallel to a tangent of the grinding wheel at a point at which the grinding wheel contacts the surface; and the spaces between the lines comprise the non-reflecting lines of the bar code.

16. A device for forming markings in a cylindrical surface of an object comprising:

means for holding the object;

a grinding wheel for grinding the cylindrical surface of the object so as to form the markings; and means for controlling the grinding wheel and the holding means;

wherein an axis of the cylindrical surface is parallel to a tangent of the grinding wheel at a point at which the grinding wheel contacts the surface; and the holding means can rotate the object around the axis.

17. The device of claim 16, wherein the means for holding comprises a mechanical stage, the mechanical stage including means for moving the object in a first direction relative to the removing means, and means for rotating the object.

18. The device of claim 17, wherein the grinding wheel is of a thickness of less than about 0.008 inch.

19. The device of claim 16, further comprising a motor to which the grinding wheel is mounted for rotating the grinding wheel; and means for moving the motor in a second direction relative to the holding means.

20. The device of claim 19, wherein the means for moving the motor comprises:

a ferromagnetic portion on a housing of the motor;

a flexible member, the motor being mounted at about the first end of the flexible member;

a base on which the second end of the flexible member is mounted;

an electromagnet mounted on the base, wherein actuation of the electromagnet attracts the ferromagnetic portion and thereby moves the grinding wheel with respect to the base member.

21. The device of claim 16, wherein the means for controlling comprises:

means for accepting data as to the markings;

means for transforming the data into movements of the holding means in the first direction, movements of the grinding wheel in the second direction, and movements of the holding means for rotating the object, so as to bring the holding means and the grinding wheel into proximity.

22. The device of claim 21, further comprises means for verifying that the grinding wheel has formed the markings in accordance with the data.

23. The device of claim 16, further comprising means for placing the object of the holding means.

24. The device of claim 16, wherein the markings comprise a bar code.

25. A device for forming markings in the surface of an object, comprising:

holding means for holding the object;

means including a ferromagnetic portion, for removing material from the surface of the object so as to form the markings;

a flexible member, the removing means being mounted at about a first end of the flexible member;

a base member on which a second end of the flexible member is mounted; and an electromagnet mounted on said base;

wherein actuation of the electromagnet attracts the ferromagnetic portion and thereby moves the removing means with respect to the base member.

26. The device of claim 25 wherein:

the object has a cylindrical surface on which the markings are formed;

the holding means can move the object along an axis of the cylindrical surface and rotate the object around the axis; and the removing means comprises a grinding wheel positioned so that the axis of the cylindrical surface is parallel to a tangent of the grinding wheel at a point at which the grinding wheel contacts the surface.

27. The device of claim 26 wherein the removing means further comprises a motor connected to the grinding wheel.

28. The device of claim 25 wherein:

the flexible member is brass about 0.02 mm thick being a U-shape in cross section and having a width about equal to its height;

the first end of the flexible member is the connection portion of the U-shape; and the second end of the flexible member is the leg portion of the U-shape.

* * * * *